United States Patent [19]

Mazzanti

[11] Patent Number: 4,459,895

[45] Date of Patent: Jul. 17, 1984

[54] RECOIL REDUCING DEVICE FOR FIREARMS

[76] Inventor: Vincent E. Mazzanti, 1020 Prospect St., La Jolla, Calif. 92037

[21] Appl. No.: 308,440

[22] Filed: Oct. 5, 1981

[51] Int. Cl.[3] ..... F41C 21/18

[52] U.S. Cl. ..... 89/14 C

[58] Field of Search ..... 89/14 B, 14 C, 14 D

[56] References Cited

U.S. PATENT DOCUMENTS

| | | | |
|---|---|---|---|
| 858,745 | 7/1907 | McClean | 89/14 C |
| 1,605,393 | 11/1926 | Cutts | 89/14 C |
| 2,792,760 | 5/1957 | Hammer | 89/14 B |

FOREIGN PATENT DOCUMENTS

| | | | |
|---|---|---|---|
| 911049 | 6/1946 | France | 89/14 C |

*Primary Examiner*—Stephen C. Bentley

*Attorney, Agent, or Firm*—Charles C. Logan, II

[57] ABSTRACT

A recoil reducing device for firearms having an elongated tubular member with an x-axis. One end of the tubular member has structure on it for detachably connecting the tubular member to the axial end of the gun barrel of a firearm. The tubular member has structure for causing the expanding gases that are released during the firing of a bullet from a firearm to exit radially from the tubular member in a helical spiral path. This structure comprises a plurality of longitudinally spaced slots in the outer wall of the tubular member. These slots extend radially inwardly a sufficient distance to communicate with the bore of the tubular member. These slots are 180 degrees more or less of the diameter of the tubular member and each of the successive longitudinally spaced slots are sequentially rotated a predetermined number of degrees about the circumference of the tubular member to form a helical pattern through which the exhaust gases of a bullet will pass as they exit the lateral sides of the tubular member.

6 Claims, 8 Drawing Figures

RECOIL REDUCING DEVICE FOR FIREARMS

BACKGROUND OF THE INVENTION

The invention rleates to firearms, and more particularly to a novel recoil reducing device for firearms. For hundreds of years, people have been shooting guns and experiencing the recoil produced upon firing the bullet. The amount of recoil can be quite large depending on the caliber of gun being fired. This excessive recoil force greatly affects the accuracy or ability of the person firing the gun to fire repeated shots at a target.

It is an object of the invention to provide a novel recoil reducing device for a firearm that will neutralize or negate a portion of the guns normal rearward recoil.

It is also an object of the invention to provide a novel recoil reducing device for a firearm that will be easy to manufacture and assemble.

It is also an object of the invention to provide a novel recoil reducing device for firearms that will allow physically smaller or weaker persons to fire higher caliber guns.

It is a further object of the invention to provide a novel recoil reducing device for firearms that will allow higher caliber guns to be made lighter.

SUMMARY OF THE INVENTION

Applicant's novel recoil reducing device for firearms is designed to neutralize or negate a portion of the guns normal rearward recoil. The system is adaptable to existing guns and it can be included in the design of guns to be manufactured.

The novel recoil reducing device for firearms utilizes a gunbarrel having an axially extending bore. The end of the gunbarrel is modified to have an externally threaded shank portion. The recoil reducing device has as one of its major components an elongated tubular member; and one end of this has an internally threaded end portion, which screws on to the threaded shank portion of the gun barrel. The gun barrel itself could alternatively be modified to produce a structure essentially the same as that of one of the preferred embodiments that is described in a later portion of the specification.

In one of the preferred embodiments, a plurality of disc-shaped baffle members are longitudinally spaced a predetermined distance from one another within the elongated tubular member. These baffle members each have a substantially half-moon configuration with a cut-out portion at their arcuate center large enough to allow a fired bullet to pass thereby without impeding its travel. Each of these successive longitudinally spaced baffle members are sequentially rotated a predetermined number of degrees about the x-axis of the tubular member to form a helical passage for gases passing through the tubular member.

The recoil reducing device also has a tubular sleeve member whose inner diameter is substantially the same as the external diameter of the tubular member. The tubular member has a substantial portion of its length located within the bore of the sleeve member. There are a plurality of radial apertures in the tubular member that are aligned with radial apertures in the sleeve member. These apertures are longitudinally spaced a predetermined distance from one-another along the length of the tubular member and sleeve member. Each of these successive longitudinally spaced apertures are sequentially rotated a predetermined number of degrees about the circumference of the tubular member to form a helical pattern through which the exhaust gases of a bullet will pass as they exit the lateral sides of the tubular member and sleeve member.

In another preferred embodiment, the recoil reducing device for firearms has an elongated tubular member with an x-axis. One end of the tubular member has structure on it for detachably connecting the tubular member to the axial end of the gun barrel of a firearm. The tubular member has structure for causing the expanding gases that are released during the firing of a bullet from a firearm to exit radially from the tubular member in a helical spiral path. This structure comprises a plurality of longitudinally spaced slots in the outer wall of the tubular member. These slots extend radially inwardly a sufficient distance to communicate with the bore of the tubular member. These slots are 180 degrees more or less of the diameter of the tubular member and each of the successive longitudinally spaced slots are sequentially rotated a predetermined number of degrees about the circumference of the tubular member to form a helical pattern through which the exhaust gases of a bullet will pass as they exit the lateral sides of the tubular member.

In the first preferred embodiment previously described, as a bullet is fired, it will travel axially along the bore of the gunbarrel and behind it travels a mass of gases. As the bullet passes through the novel recoil reducing device, the mass of gases immediately behind the bullet finds that it has additional paths which it may travel in addition to following directly along the exit-axis of the gunbarrel. This results in disruption of this compact mass of gases causing a portion thereof to follow a helical path through the length of the tubular member. As a portion of these masses are traveling this helical path along the length of the tubular member, the amount of disruption to the mass of gases that has continued to follow immediately behind the bullet is increased greatly and has a resultant effect of reducing the recoil action of the firearm. Additional portions of the mass of gases passing along behind the bullet also exit radially through the aligned apertures in the lateral walls of the tubular member and sleeve member. This results in additional dissipation of the recoil force normally produced by the firing of the gun. The gases escaping from the lateral walls of the tubular member and sleeve member also follow a spiraling helical path.

In the second preferred embodiment previously described, the mass of gases immediately behind the bullet will also find that it has additional paths which it may travel in addition to following directly along the exit-axis of the gun barrel. This results in disruption of this compact mass of gases causing a portion, thereof, to exit radially against the front walls of the longitudinally spaced slots formed in the outer walls of the tubular member. This results in a forward force against these front walls that lessens or neutralizes the normal recoil of the firearm. These front walls function as baffles that after initially being struck, direct the gases both radially outwardly through the slots and also rearwardly. Since the successive longitudinally spaced slots are sequentially rotated a predetermined number of degrees about the circumference of the tubular member, the exiting gases will form a helical pattern as they exit the slots.

DESCRIPTION OF THE PREFERRED EMBODIMENT

Figure 1:
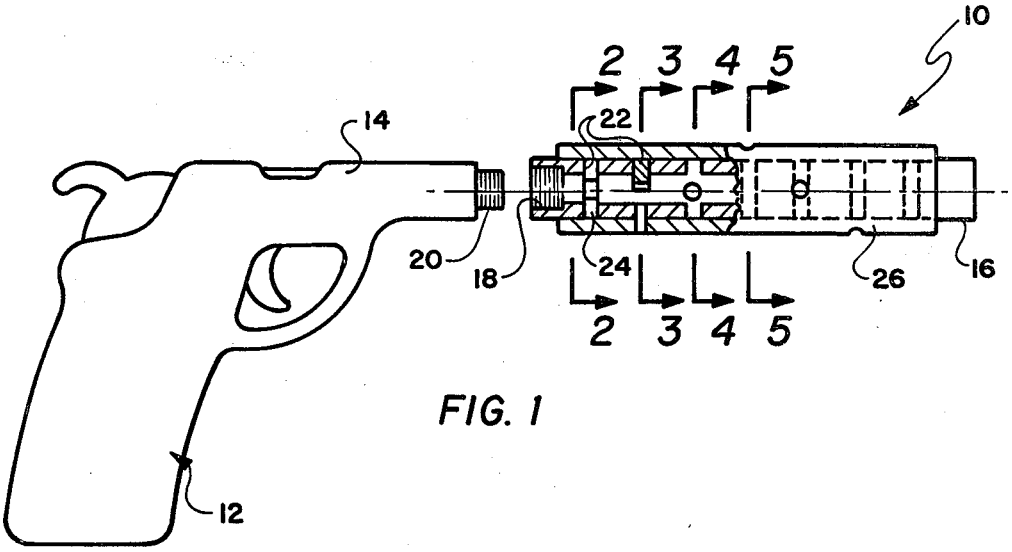
FIG. 1 is a side elevation view of a gun illustrating how applicant's novel recoil reducing device is attached thereto.
Figure 2:
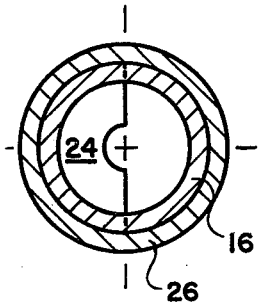
FIG. 2 is a cross-sectional view taken along lines 2—2 of FIG. 1.
Figure 3:
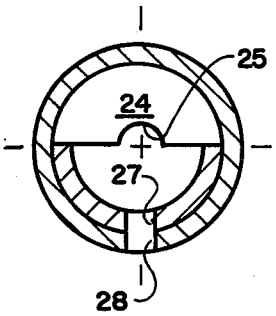
FIG. 3 is a cross-sectional view taken along lines 3—3 of FIG. 1.
Figure 4:
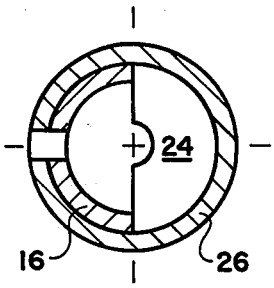
FIG. 4 is a cross-sectional view taken along lines 4—4 of FIG. 1.
Figure 5:
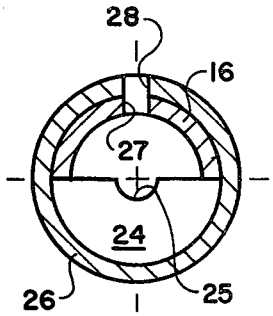
FIG. 5 is a cross-sectional view taken along lines 5—5 of FIG. 1.

One of the novel recoil reducing devices is generally designated numeral 10 and it will be described by referring FIGS. 1–5.

A revolver 12 has a gun barrel 14 whose bore passes along the x-axis.

The recoil reducing device 10 has as a major component, an elongated tubular member 16 whose end portion 18 is internally threaded. Threaded end portion 18 is screwed on to the threaded shank portion 20 on gun barrel 14.

Tubular member 16 has a plurality of longitudinally spaced slots 22 passing through its radial wall and a disc-shaped baffle member 24 is captured within each of these slots 22. Baffle members 24 have a substantially half-moon configuration with a cut-out portion 25 at their arcuate center large enough to allow a fired bullet to pass thereby without impeding its travel. The success of longitudinally spaced baffle members 24 are sequentially rotated approxmately 90 degrees about the x-axis of tubular member 16 to form a helical passage for gases passing through the tubular member.

A tubular sleeve member 26 has an inner diameter substantially the same as the external diameter of tubular member 16. A plurality of radial apertures 27 and 28, respectedly ends tubular member 16 and sleeve member 26, are longitudinally spaced a predetermined distance from one another along the length of the recoil reducing device 10. Each of the successive longitudinally spaced apertures 27 and 28 are sequentially rotated approximately 90 degrees about the circumference of tubular member 16 and sleeve member 26 to form a helical pattern through which the exhaust gases of a bullet will pass as they exit the lateral sides of the tubular member and sleeve member.

Figure 6:
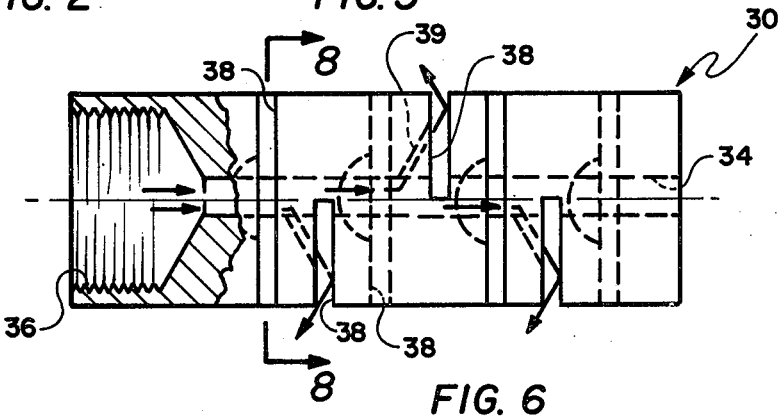
FIG. 6 is a side elevation view of an alternative recoil reducing device having a portion broken away for clarity.
Figure 7:
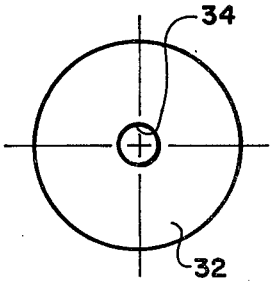
FIG. 7 is a front elevation view of the alternative recoil reducing device.
Figure 8:
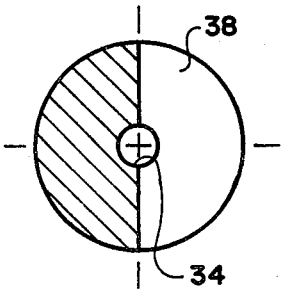
FIG. 8 is a cross sectional view taken along lines 8—8 of FIG. 6.

An alternative recoil reducing device 30 is illustrated in FIGS. 6–8. The basic component is a tubular member 32 having a bore 34 passing along its length. For the alternative recoil reducing device, tubular member could also be the gun barrel itself of the firearm. Tubular member 32 has an internally threaded end portion 36 that may be screwed on to the threaded shank portion 20 of a revolver 12. Tubular member 32 has a plurality of longitudinally spaced slots in its outer wall and these slots pass radially inwardly far enough to communicate with the bore 34 of tubular member 32. These slots 38, constitute substantially 180 degrees of the diameter of the tubular member 32; and their forward wall surface acts as a baffle surface against which a portion of the escaping gases direct a forward thrust prior to escaping radially outwardly and rearwardly. Beveled portions 39 of the rearward wall of slots 38 aid in directing the gases against the forward walls of slots 38. The successive longitudinally spaced slots 38 are sequentially rotated approxmately 90 degrees about the circumference of tubular member 32 to form a helical pattern through which the exhaust gases of a bullet will pass as they exit the lateral sides of tubular member 32.

I claim:

1. A recoil reducing device for a firearm having a gun barrel with a front end comprising:

an elongated tubular member having an x-axis;

means on one end of said tubular member for detachably connecting said tubular member to the front end of the gun barrel of a firearm;

means for causing expanding gases, that are released during the firing of a bullet form a firearm, to travel axially along the length of said tubular member in a helical sprial path comprising:

a plurality of disc-shaped baffle members, said baffle members each having a substantially half-moon configuration with a cut-out portion of their arcuate center large enough to allow a fired bullet to pass thereby without impeding its travel, said baffle members being longitudinally spaced a predetermined distance from one another within said elongated tubular member, each of said successive longitudinally spaced baffle members being sequentially rotated a predetermined number of degrees about the x-axis of said tubular member to form a helical passage for gasses passing through said tubular member.

2. A recoil reducing device for firearms as recited in claim 1 further comprising means for maintaining said predetermined longitudinal spacing of said baffle members within said elongated tubular member.

3. A recoil reducing device for firearms as recited in claim 2 wherein said means for maintaining said predetermined spacing comprises a plurality of slots passing through the wall of said tubular member and into which said baffle members are inserted.

4. A recoil reducing device for firearms as recited in claim 1 further comprising a tubular sleeve member having an inner diameter substantially the same as the external diameter of said tubular member, said tubular member having a substantial portion of its length located within the bore of said sleeve member.

5. A recoil reducing device for firearms as recited in claim 1 further comprising a plurality of radial apertures in said tubular member, said apertures being longitudinally spaced a predetermined distance from one another along the length of said tubular member, each of said successive longitudinally spaced apertures being sequentially rotated a predetermined number of degrees about the circumference of said tubular member to form a helical pattern through which the exhaust gases of a bullet will pass as they exit the lateral sides of said tubular member.

6. A recoil reducing device for firearms as recited in claim 1 wherein said exit end of said tubular member is open thereby allowing some of the expanding gases to exit therefrom.

* * * * *